US006546908B1

(12) United States Patent
Pekau

(10) Patent No.: US 6,546,908 B1
(45) Date of Patent: Apr. 15, 2003

(54) VARIABLE GEOMETRY TOROIDAL ENGINE

(75) Inventor: Rudolf R. Pekau, Calgary (CA)

(73) Assignee: VGT Technologies, Inc., Calgary (CA)

( * ) Notice: Subject to any disclaimer, the term of this patent is extended or adjusted under 35 U.S.C. 154(b) by 0 days.

(21) Appl. No.: 09/913,693

(22) PCT Filed: Aug. 4, 2000

(86) PCT No.: PCT/CA00/00917

§ 371 (c)(1),
(2), (4) Date: Nov. 8, 2001

(87) PCT Pub. No.: WO97/43519

PCT Pub. Date: Nov. 20, 1997

(51) Int. Cl.[7] ..... F02B 53/10
(52) U.S. Cl. ..... 123/206; 123/206; 123/289
(58) Field of Search ..... 123/206, 221, 123/228, 229

(56) References Cited

U.S. PATENT DOCUMENTS

| | | | | |
|---|---|---|---|---|
| 3,208,437 A | | 9/1965 | Coulter | 123/13 |
| 3,797,237 A | * | 3/1974 | Kamiya | 60/39.61 |
| 4,026,249 A | * | 5/1977 | Larrea | 123/8.47 |
| 4,035,111 A | | 7/1977 | Cronen, Sr. | 418/38 |
| 4,242,591 A | | 12/1980 | Harville | 290/1 R |
| 4,683,852 A | | 8/1987 | Kypreos-Pantazis | 123/230 |
| 4,753,073 A | | 6/1988 | Chandler | 60/519 |
| 5,046,465 A | | 9/1991 | Yi | 123/248 |
| 5,203,297 A | * | 4/1993 | Iversen | 123/248 |
| 5,645,027 A | | 7/1997 | Esmailzadeh | 123/245 |
| 6,257,195 B1 | * | 7/2001 | Vanmoor | 123/239 |

FOREIGN PATENT DOCUMENTS

| | | |
|---|---|---|
| DE | 41 27 870 A1 | 1/1992 |
| DE | 195 09 913 A | 9/1996 |
| EP | 0 933 500 A1 | 8/1999 |
| GB | 403066 A | 3/1932 |
| WO | WO 97/43519 | 11/1997 |

* cited by examiner

*Primary Examiner*—Hoang Nguyen
(74) *Attorney, Agent, or Firm*—Woodcock Washburn LLP

(57) ABSTRACT

A novel rotary engine has a single toroidal cylinder and a set of pistons on a rotating circular piston assembly. A rotating disk valve perpendicular to the toroid has a cutout position which periodically traverses the chamber to allow passage of a piston therethrough. The geometry of the pistons and the valve are arranged to minimize the residual volume, by altering the geometry of the chamber section formed between valve and piston and/or providing pistons which are mechanically extendible and retractable in synchronization with the opening and closing of the disk valve, to optimize engine efficiency and performance.

19 Claims, 9 Drawing Sheets

VARIABLE GEOMETRY TOROIDAL ENGINE

BACKGROUND OF THE INVENTION

1. Field of the Invention

The present invention relates to a rotary engine, and more particularly to an internal combustion engine in which a piston assembly orbits continuously within a toroidal chamber.

2. Description of the Prior Art

The conventional technology for internal combustion engines is the reciprocating piston engine which has evolved and been refined over a period of some 125 years. That kind of engine is, however, subject to a number of widely recognized, severe limitations and constraints in power generation efficiency.

The reciprocating piston engine does not produce rotary motion with a constant torque arm but, rather, uses a crankshaft to convert reciprocating motion of a piston into rotary motion, with the attendant disadvantage of a variable torque arm that is drastically reduced in the top dead centre region of the piston when combustion is initiated. The result is a lack of torque and power and a reduction of engine efficiency.

Many attempts have been made to produce a workable "toroidal piston engine" which provides revolving pistons mounted to a central disk to produce the desired constant torque arm, Examples of this kind are to be found in U.S. Pat. No. 4,035,111 (Cronen, Sr.); U.S. Pat. No. 4,242,591 (Harville); U.S. Pat. No. 4,683,852 (Kypreos-Pantazis); U.S. Pat. No. 4,753,073 (Chandler); U.S. Pat. No. 5,046,465 (Yi); U.S. Pat. No. 5,203,297 (Iversen); and U.S. Pat. No. 5,645,027 (Esmailzadeh).

In common with all positive displacement combustion engines, the toroidal engine must incorporate means both for compressing the intake charge and for containing the hot expanding gasses that are generated by combustion. In keeping with this principle, previous inventors of toroidal engines have usually made provision for some sort of "valve" to intercept the path of the advancing piston, to retract and so allow the piston to pass by, then to close behind the piston.

In this manner, the intake charge is compressed between the advancing piston and the valve blocking its path. The compressed charge is then diverted into a combustion chamber, the valve is briefly opened to allow the piston to pass by, the valve closes and the ignited combustion gases, released from the combustion chamber, expand between the closed valve and the retreating rear face of the piston. Accordingly, each piston is propelled on a circular orbit as it passes through the valve aperture.

My study of the prior art, experiments which I have conducted and computer-assisted thermodynamic modelling results have led me to conclude that the reason none of these approaches has achieved commercial success stems from general failure to address a fundamental problem inherent in the operation of toroidal engines, namely, the loss in compression potential and the loss in air mass which occurs between the front face of a piston and a valve intersecting the toroidal chamber in advance of that piston and, likewise, the pressure loss which occurs between the rear face of the piston and the intersecting valve behind that piston. Thus, that air mass between the advancing face of a piston and the intersecting valve which is not diverted into the combustion chamber, but escapes into the toroidal chamber, is "lost" to the useful generation of work.

In a toroidal piston engine of this general kind, some mechanism is required for opening and closing a valve seat in advance of and then behind a moving piston to gain the mechanical energy resulting from compression, ignition and expansion. Any such mechanism will take a certain amount of time to open or close and, to that extent, the piston will have travelled further in its angular rotary motion, creating and enlarging a "residual volume" (or, equivalently, "dead volume"). This effect can lead to a loss in compression ratio, a loss in air mass, and concomitant loss of expansion pressure, in turn resulting in significant inefficiency and loss of power.

Hitherto, the designers of toroidal engines have apparently acted on the assumption that merely to block the path of the advancing piston with a valve and to trap the intake charge will generate adequate compression, with no loss of air mass, and adequate pressurization of the toroidal chamber. Prior known engines of this kind have never achieved this desired result, however, as each employs one or another intersecting valve opening-and-closing mechanism which is too slow. This results in unacceptably large residual volumes produced ahead of and behind the valve by the rapidly moving pistons.

As a specific example, the aforementioned patent to Kypreos-Pantazis discloses a rotating piston internal combustion engine in which the mechanism for opening and closing the toroidal chamber in advance of and behind a piston comprises separating walls adapted to move radially inwardly and outwardly to divide the toroid inner space into sub-chambers. The means to withdraw the separating walls to allow the passage of a piston and thereafter reinsert it is typically a cam coupled mechanically to the central output shaft of the engine to withdraw the walls periodically from the toroid chamber as the shaft and piston assembly rotates, and return springs for reinserting the walls into the toroid chamber.

A practical problem with that and with other prior art toroidal engines is that their opening-and-closing mechanisms create significant residual volume between the front and rear of the piston, resulting in entirely unsatisfactory performance. I have employed thermodynamic mathematical modelling to demonstrate the inevitability of the practical failure of toroidal engines using such mechanisms. All of the prior art exemplified in the patent literature employs either planar sliding valves or planar rotating valves, which are required to move in reciprocating fashion owing to the configuration of the toroid. At the high rotational speeds required by an engine cycle, reciprocating mechanisms are very difficult to seal and to maintain.

The same thermodynamic mathematical modelling and analysis also revealed a surprisingly drastic improvement in the performance of toroidal piston engines where the residual volumes are contrived to be made as small as possible. Indeed, the dead volume would ideally be zero but as a practical matter, of course, the moving piston and the valve in its closed position must never physically contact each other.

The practical conclusion of my analysis is that a toroidal engine of this general kind becomes usefully workable only where the volume in the compression phase of the cycle (between the piston and valve) is physically reduced sufficiently to generate a compression ratio approximating the value achieved in conventional reciprocating piston engines and the loss of air mass is minimized to achieve an efficiency comparable to conventional engine technology. That ratio, in an SI engine, typically lies in the range of between 8:1 and 12:1 or, in the case of the Diesel engine, approximately 18:1.

The fundamentally different approach I have taken to improving the performance of toroidal piston engines of this kind is to alter the geometry of the chamber section formed between valve and piston to minimize the residual volumes and thereby attain the very significant improvement in performance which was predicted by the analysis of models. For that reason, I refer to my invention as the "variable geometry toroidal engine" or VGT engine. As discussed below, the aforementioned geometry can be varied by employing a rotating disk valve with an aperture that periodically intersects the toroidal chamber and minimizing the residual volumes between piston and valve.

In a first principal embodiment the reduction in the residual volumes is achieved by matching the three-dimensional shape of the piston to the valve opening. According to a second principal embodiment, it is achieved by providing a piston which is mechanically expandible and contractible, to minimize the residual volumes between the piston and the valve just prior to opening of the valve and just following shutting of the valve.

SUMMARY OF THE INVENTION

It is a principal object of the invention to provide a toroidal engine in which the residual volumes between the piston and the closed disk valve are minimized to achieve superior performance characteristics.

It is a further object of the present invention to provide a toroidal piston engine in which the volume between piston and valve in a compression phase of the working cycle is sufficiently small to generate a compression ratio of a value approximating that achieved in conventional reciprocating engines.

It is a further object of the present invention to provide an engine as aforesaid which will run smoothly with virtually no vibration.

It is a further object of the invention to provide an engine as aforesaid which is compact and which can be built as a gasoline engine running on the Otto cycle or as a Diesel engine by the expedient of reducing the volume of a combustion chamber with an adjustable counterpiston and changing the fuel system to Diesel fuel.

It is a further object of the present invention to provide an efficient, pneumatically powered rotary engine for use in environments where combustion is unduly hazardous, as an air motor providing high torque at low rpm.

It is a further object of the present invention to provide a rotary motor which can operate as a steam motor with comparable or superior performance to conventional steam turbines but at significantly lower cost of production.

It is a further object of the present invention to provide an efficient rotary engine which with a suitable injection system can be built as an engine fuelled by the combustion of hydrogen.

With a view to achieving these objects and overcoming the aforementioned disadvantages of prior rotary internal combustion engines, the present invention provides an engine having pistons rotating through a non-circular cross-section toroidal chamber which is intersected by a continuously rotating disk valve having a shutter-like cutout therethrough. Two counter-rotating disk valves may be used to decrease the opening and shutting times still further.

The shape of the pistons, the chamber through which they move and the cutout portion of the continuously rotating disk valve, unlike prior art toroidal piston motor arrangements, are designed with a view to minimizing the residual volume, thereby enhancing the compression ratios to levels which are useful in practice.

According to a first principal embodiment of the invention, the residual volumes are minimized by having the shape of each piston matched to the non-circular geometry of the toroid and having the trailing and leading edges of each piston formed with a three-dimensional curvature such that the outer surface of each piston remains as close as practicable to the interior walls of the valve cutout as the piston passes through, during operation of the engine.

According to a second principal embodiment of the invention, the residual volumes are minimized by providing pistons which are mechanically extendible and retractable, in conformity with the speed of passage of the piston through the disk valve, so as to minimize the residual volumes.

The various advantages and features of the VGT engine according to the present invention will be apparent from the following detailed description, wherein reference is made to the figures in the accompanying drawings.

DETAILED DESCRIPTION OF PREFERRED EMBODIMENTS

The basic co-operating components of the VGT engine according to the invention are to be seen in the views of FIGS. 1 through 4*c*.

Figure 3:
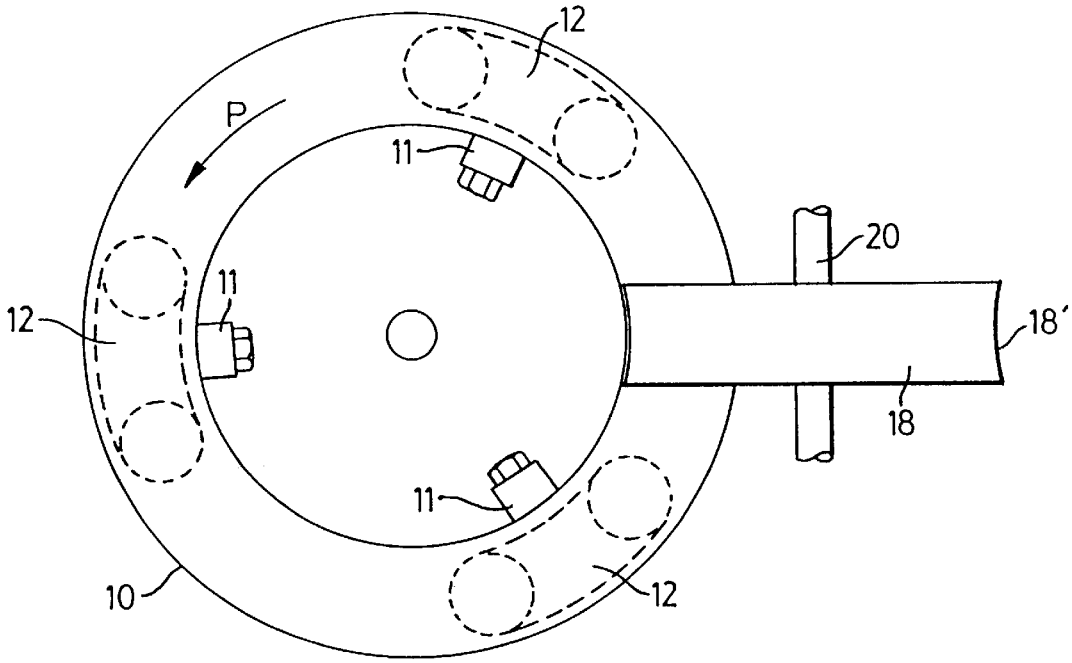
FIG. 3 schematically isolates details of the toroid, pistons and flat disk valve in a VGT engine of the kind illustrated in FIGS. 1 and 1*a;*

The engine comprises a toroidal chamber 10 within which several pistons 12 rotate in unison. Two, three or four pistons 12 are mounted circumferentially and equiangularly to a disk 14 by means of screws or bolts 11. FIG. 3 presents a "stripped down" schematic illustration of the relative disposition of toroidal chamber 10, rotating disk valve 18 and pistons 12 (three in the embodiment illustrated in the drawings). Co-axially oriented with the axis of toroidal chamber 10 is a drive or output shaft 16 for delivery of torque developed by the motor.

My novel mechanism for effectively opening and closing a valve in advance of and behind a moving piston comprises a circular disk valve 18 having a cutout portion 19 for passage therethrough of a piston. Disk valve 18 is mounted on a separate actuating shaft 20 at right angles to the axis of output shaft 16. The edge surface 18' of disk valve 18 is of a concave curvature which conforms to the circularity of rotating mounting disk 14. As discussed in more detail below, the rotation of disk valve 18 is synchronized with the rotary motion of pistons 12.

Compression is achieved in the VGT engine by the timed intersection of toroidal chamber 10 with rotating disk valve 18. I have found that a part-circular cutout in a rotating disk can effectively serve as the opening for a rotating valve in a toroidal engine, provided the toroidal cross-section and the pistons are given a "variable geometry" which allows the piston and the solid portion of the rotating valve to approach each other as closely as possible without touching in both the compression and expansion phases.

Figure 2:
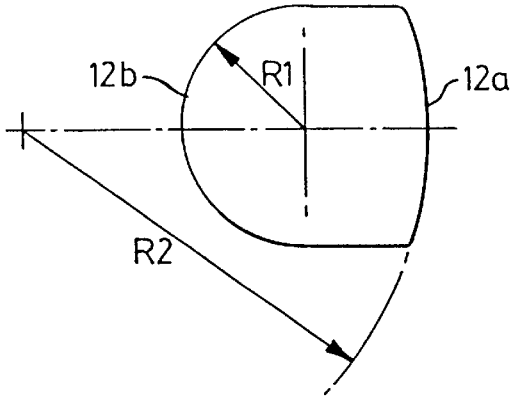
FIG. 2 is an end view of a selectively shaped piston which may be used in an engine according to the present invention, illustrating the non-circular peripheral contour, with two convex surface portions having different radii of curvature.

According to a first preferred embodiment of the invention, the "variable geometry" consists in matching the piston contour to the toroidal chamber and the disk valve cut-out. The peripheral shape of a "dual radius" toroidal piston (and of the chamber cross-section which accommodates the piston) is illustrated in FIG. 2. The nearest practicable approach to flush sealing between the piston and the valve, given the intersecting rotational movements of disk 14 and disk 18 in perpendicular plane, is achieved by having the piston shaped with a curved inner side surface portion 12*a* having a radius R2 equal to the radius of curvature of rotating disk 18, and a curved outer side surface portion 12*b* of a smaller radius of curvature R1 conforming to the interior curvature of the toroidal chamber 10.

Figure 1:
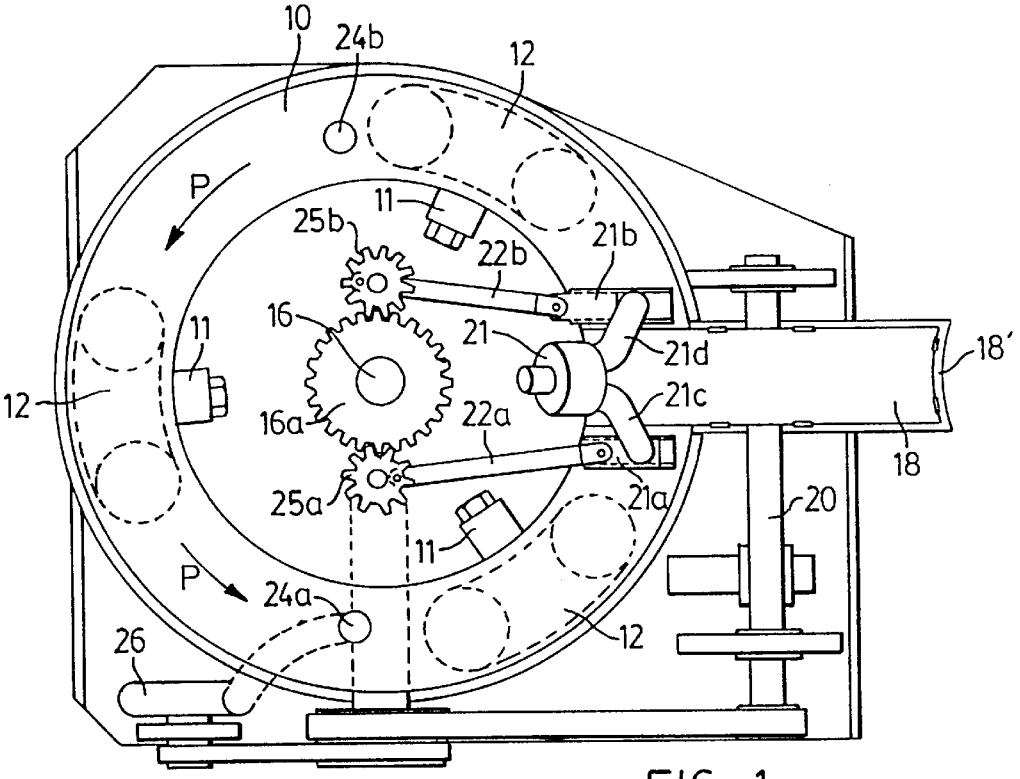
FIGS. 1 and 1*a* are schematic drawings in plan and in part-sectional side elevational view, respectively, of the general arrangement of components in a VGT toroidal piston engine according to the present invention.
Figure 1A:
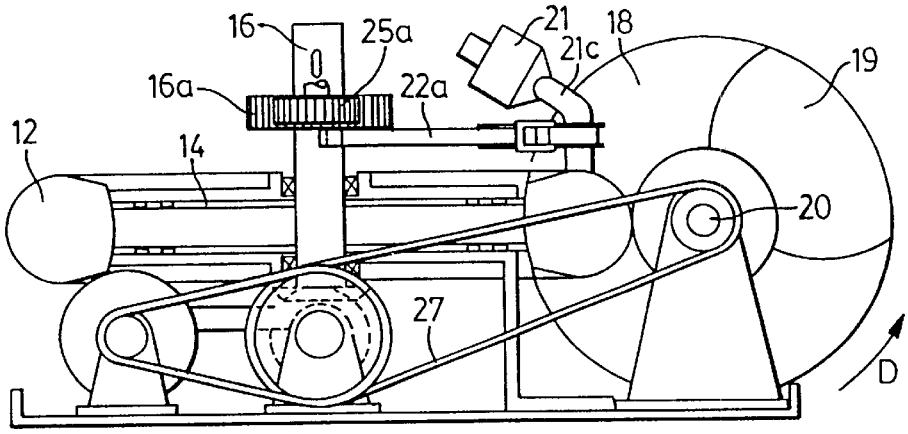

The surface portion 12' connecting surface portion 12*a* to surface portion 12*b* may be parallel planar surfaces as illustrated in FIG. 2, or else slightly inwardly convergent, as represented in FIG. 1*a*.

The "matching" that particularly assists in minimizing the dead volumes, however, is achieved by forming appropriately contoured three-dimensional surfaces at the front and rear faces of both the piston and the disk valve.

Figure 4C:
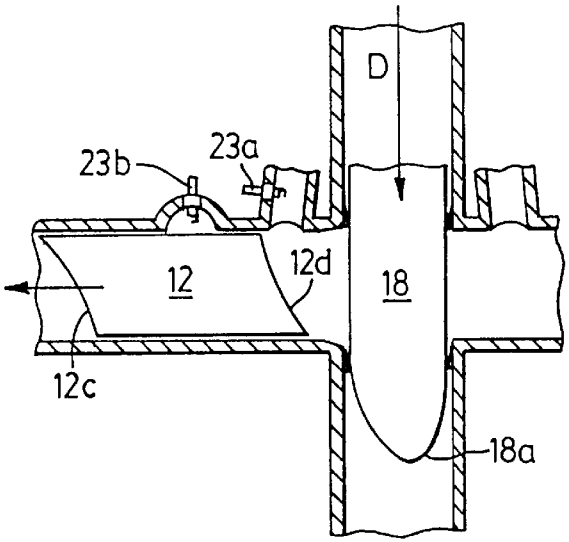
FIGS. 4*a*, 4*b* and 4*c* are detailed sectional views, sequentially showing the passage of a piston through the cutout portion of a rotating disk valve in a VGT engine according to the present invention, particularly illustrating the novel curvature of a piston over its front and rear faces.
Figure 4B:
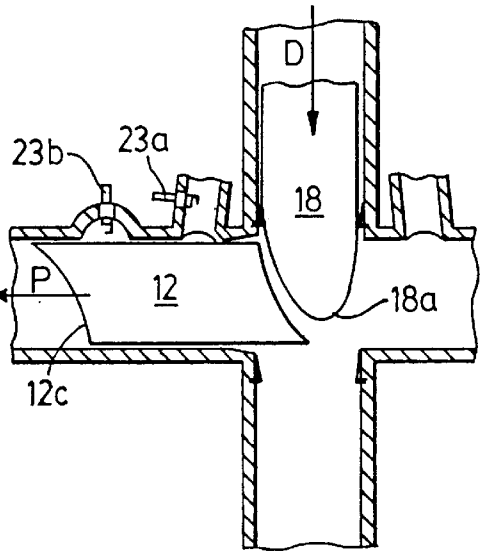
Figure 4A:
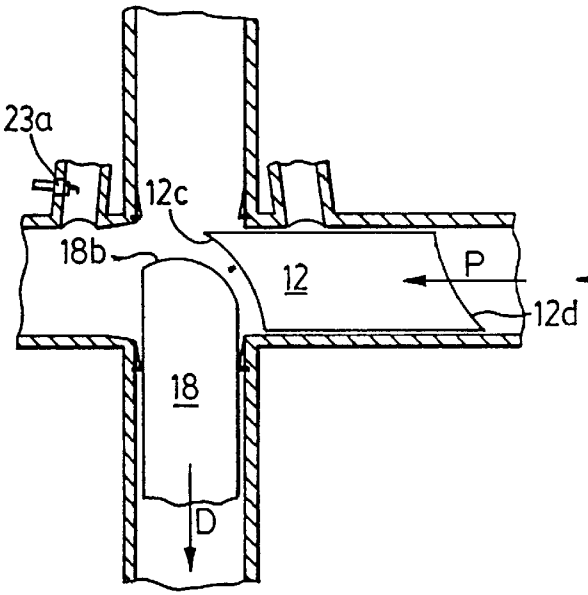

This is best seen in the views of FIGS. 4*a* to 4*c*, the temporal sequence of which is explained in greater detail below. In order to minimize the residual volumes formed between piston 12 and disk valve 18, the front (leading) face 12*c* of piston 12 and its rear (trailing face) 12*d* are slanted relative to the plane of rotation and three-dimensionally curved to conform to convex front edge surface contour and rear edge surface contour 18*a* and 18*b*, respectively, of disk valve 18.

As illustrated in the embodiment shown in FIGS. 1*a* and 1*b*, the engine includes a bypass combustion chamber 21 where the majority of compressed air is stored and burned with injected fuel, while a piston 12 bypasses the combustion chamber. A combustion chamber inlet valve 21*a* and a combustion chamber exit valve 21*b* are also synchronized, in their respective opening and closing, with the motion of pistons 12 for opening and closing of transfer passages 21*c* and 21*d*, respectively, which joing the combusiont chamber to the cylinder chamber. This synchronization may be effected, for example, by reciprocating connecting rolls 22*a* and 22*b* operatively geared to a gear wheel 16*a* fixed to drive shaft 16 by actuating gears 25*a* and 25*b*.

The basic working cycle of a VGT engine is analogous to that of reciprocating engines. The compression stroke is effected by the front face 12*c* of the piston and the power stroke by the rear face 12*d*.

Throughout the figures, the directions of motion of the piston and the disk valve are indicated by arrows P and D, respectively. FIG. 4*a* shows the components just subsequent to compression with the trailing edge 18*b* of the disk valve moving out of the way of advancing piston 12. Next in temporal order in FIG. 4*b* piston 12 has almost passed through disk valve 18 which is in the process of closing the space behind piston 12 for the power stroke. In FIG. 4*c*, the disk valve is closed and the high pressure combustion gasses expand into the space between disk valve 18 and the rear face 12*d* of the moving piston. Additional spark plugs may be placed in the passage to the toroidal cylinder, as at 23*a* in FIGS. 4*a* to 4*c* and/or in the toroidal chamber itself indicated by 23*b*. Fuel may also be injected into the transfer passage 21*c* or into the toroidal chamber upstream of the combustion chamber.

Air for combustion may be fed through a port 24*a* (FIG. 1*a*) on the toroidal chamber 10 by a blower or charger 26. Unlike the conventional reciprocating engine, there is no "intake stroke". The air blown in by charger 26 is compressed once piston 12 has passed air intake port 24*a*. Compression occurs in the interior of toroidal chamber 10 because disk valve 18 forms a sealed space between piston and disk. The greater part of the compressed air is stored in bypass combustion chamber 21, which is sealed off as soon as the intake valve 21*a* and the exit valve 21*b* close. The remainder of the compressed air, in the residual volume, is used later in purging the exhaust gas, once the disk valve 18 opens. Once piston 12 has passed through disk valve 18, toroidal chamber 10 is sealed off by the closing disk valve, making expansion possible. In the meantime, fuel has been injected into combustion chamber 21 and has been mixed with the air and ignited, readying the combustion gas for the expansion.

Combustion chamber 21 is preferably configured as a swirl chamber (described in greater detail below in conjunction with FIGS. 6*a* and 6*b*) and is equipped with its own sparkplug (as in an SI engine), igniting the swirling air-fuel mixture and raising the pressure. As combustion takes place, piston 12 bypasses the combustion chamber through the open disk valve 18, which then closes behind the piston as in FIG. 4*c*.

At that point, exit valve 21*b* is opened. The burning air/fuel mixture of the combustion chamber 21 escapes into the toroidal chamber 10 as a high-velocity jet through an orifice of a convergent/divergent nozzle (sometimes referred to as a "Laval nozzle"), best illustrated and described below in connection with FIG. 9. A portion of the fuel can be injected into the toroidal chamber and ignited by the burning fuel jet from combustion chamber 21, thereby raising the pressure in toroidal chamber 10 against the backside 12*b* of the piston, producing power and torque.

The piston which experiences the expansion transfers its power to the disk 14 and the main shaft 16 and drives the next advancing piston which effects the next compression phase and the cycle is repeated.

There may be one or more combustion chambers provided on the perimeter of toroidal chamber 10, each of them having its own associated disk valve for intersection of the chamber. A symmetrical arrangement of such combustion chambers can achieve a more even temperature and less heat distortion. By conventional means, cooling water from the expansion side is ducted to the cooler areas of the toroidal chamber to reduce heat distortion.

Exhaust from combustion is vented through on exhaust port 24*b* on the perimeter of toroidal chamber 10, once the piston which effects the power stroke has passed the exhaust port and causes that port to open The exhaust gases are purged by residual air from the compression stroke which was not captured in the combustion chamber. Instead of being vented to an emission control system, the exhaust gases may be used for turbocharging or a power recovery turbine.

Figure 6C:
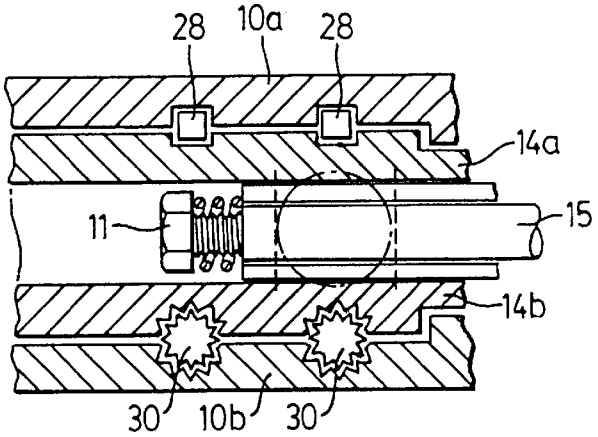
FIGS. 6*a* to 6*c* are schematic representations of various alternative sealing arrangements for the central rotating disk carrying the pistons, and of the mounting of a piston to the rotating disk in the VGT engine of FIGS. 1 and 1*a;*
Figure 6B:
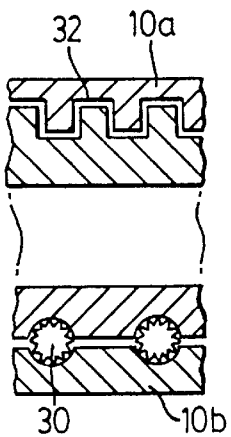
Figure 6A:
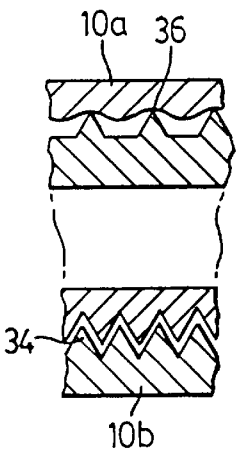

Disk valve 18 is rotationally driven by suitable gearing means and/or a timing belt 27 or chain drive for correct synchronization to achieve the above-described compression and expansion phases. Power for the disk valve drive is taken from main shaft 16 on the central disk 14. As indicated in FIGS. 6*a* to 6*c*, the toroidal chamber 10 and the disk valve 18 are provided with suitable lubricated seals 30 to minimize leakage.

Figure 5:
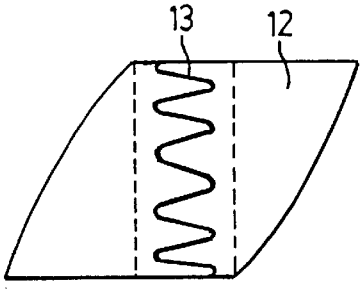
FIG. 5 schematically illustrates a variant of the piston used in the VGT engine, which is equipped with a sinusoidal piston ring for improved sealing.

As illustrated in FIG. 5, the pistons 12 may themselves advantageously be equipped with lubricated sinusoidal piston rings 13 over a constant diameter section of piston 12 to ensure good sealing during the compression stroke and the expansion stroke, and to prevent jamming of piston rings in the disk valve housing area during the by-pass stroke.

Proper sealing of the compression chamber and in particular the combustion/expansion chamber in the VGT engine is important. A number of alternative arrangements for sealing the central disk and the piston mounting are illustrated in FIGS. 6*a* to 6*c*. Piston rod 15 extends outwardly to join piston 12 (not shown). The rod is secured in place to the upper and lower portions 14*a* and 14*b* of central disk 14 by means of spring-loaded mounting bolts 11. Central disk 14 rotates with its pistons through the interior of toroidal chamber 10 which comprises an upper toroid shell 10*a* and a lower toroid shell 10*b*.

The sealing between upper toroid shell 10*a* and upper central disk and between lower toroid shell and lower central disk may be of a number of configurations and materials, depending on the end application of the engine, e.g. grooved labyrinth seals 28 on the perimeter of central disk 14. A computer model loss study which has been carried out suggests that significant benefits are enjoyed where these grooved labyrinth seals 28 are pressurized, a pressurization which is automatically achieved by the leak air until a steady state pressure has built up. This keeps leakage losses to an acceptable level. Good sealing is achieved by combining the grooved labyrinth seals 28 on the perimeter of the central disk with star-shaped rings 30 which may be made of Teflon where the VGT engine is an air- or steam-motor and of hardened steel where it is an internal combustion engine. The upper and lower toroidal shells 10*a* and 10*b* may also include an abrasive honeycomb-type seal made of superalloy or ceramic materials of the kind conventionally found in gas turbine sealing arrangements.

Alternative sealing passage shapes that may be used in particular cases are square wave 32, triangular 34 or a combination of triangular and sinusoidal 36. Noted in dotted outline in FIG. 6*c* is an optional spherical mounting for piston-carrying rod 13.

Figure 7C:
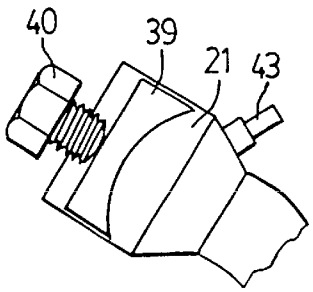
FIGS. 7*a* to 7*c* schematically illustrate preferred arrangements for the combustion chamber in a VGT engine according to the present invention.
Figure 7B:
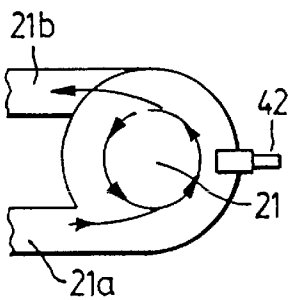
Figure 7A:
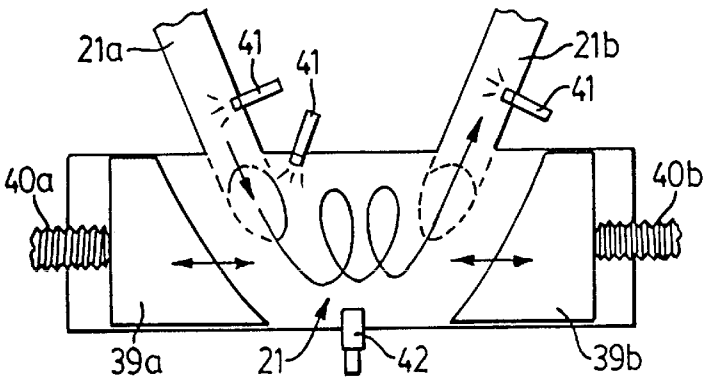

Turning to FIGS. 7*a* to 7*c*, the combustion chamber 21 may be equipped with two counterpistons 39*a* and 39*b* respectively moveable by bolts (or helices) 40*a* and 40*b* either manually or electronically using a computer controlled servomotor (not shown), to change the compression ratio, as in the arrangement of FIG. 7*a*. This allows for optimal tuning and performance under various speed/load conditions and for improving fuel economy. Moreover, it is possible to operate the engine in a Diesel mode, the adjustment over to Diesel being made while the engine is running or while the engine is shut off.

Inlet passage 21*a* to the combustion chamber 21 is positioned at the perimeter of the circular chamber, so that the entering compressed gasses create a swirl in the chamber which continues while a selected quantity of fuel is injected through fuel injectors 41 and ignited by spark plug 42. The burnt gasses exit chamber 21 through exit passage 21*b* on the opposite side of the chamber, enhancing the atomization and mixing of the air/fuel mixture.

An alternative arrangement of combustion chamber is illustrated in FIG. 7*c*, in which a single moveable counterpiston 39 is adjusted by screw 40 to tune the combustion characteristics of fuel air mixtures entering through port 21 and ignited by spark plug 43.

Figure 8:
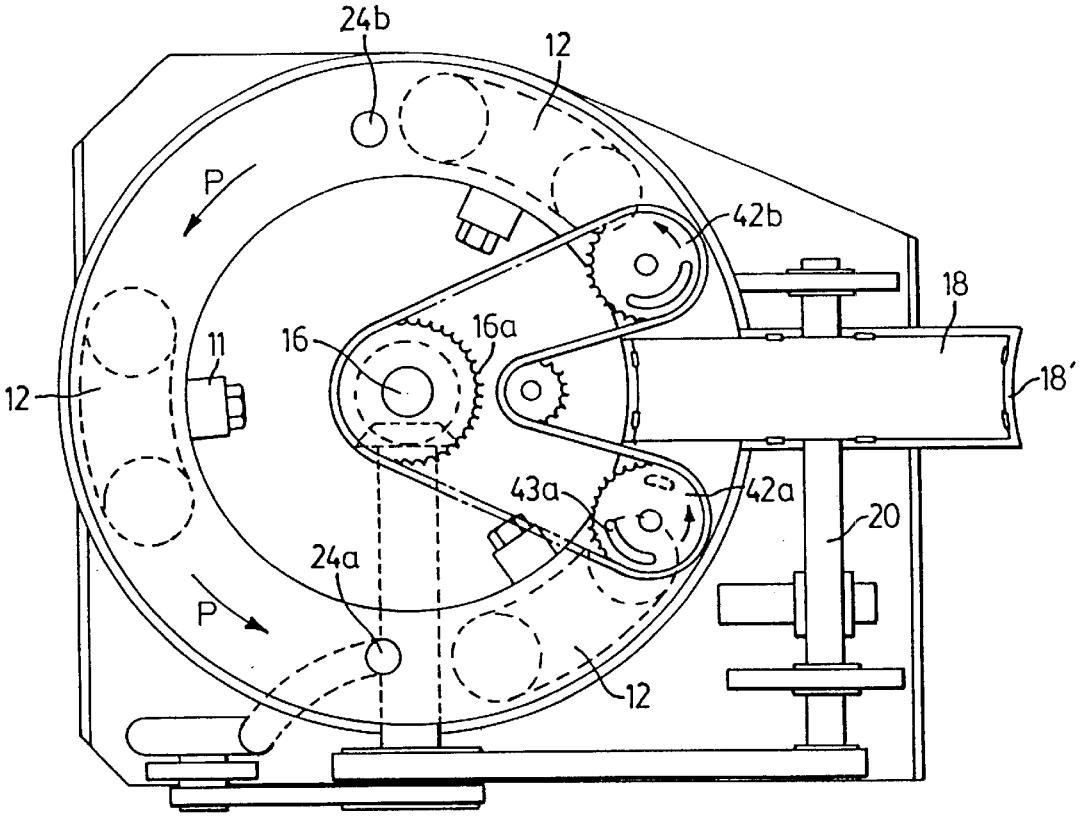
FIG. 8 is a schematic illustration of an embodiment of the invention employing rotary combustion chamber valves which operate synchronously with the disk valve, using a timing belt or chain drive arrangement.

FIG. 8 schematically illustrates an embodiment of the invention employing rotary combustion chamber valves 42*a* and 42*b*, each having a cutout 43*a* and 43*b* therethrough, with rotary combustion chamber valve 42*a* located at the inlet of the combustion chamber and rotary combustion chamber valve 42*b* at the outlet. A chain drive 44 loops over central sprocket 16*a* which is directly driven by main shaft 16 and passes over both rotary valves 42*a*, 42*b* and an idler sprocket 44 centrally mounted between them for rotation. Combustion chamber valves of the reciprocating plunger type shown in FIG. 1 are preferred for slow running engines, while combustion chamber valves of the rotary flat plate type as shown in FIG. 8 are better suited to fast running engines.

Figure 9:
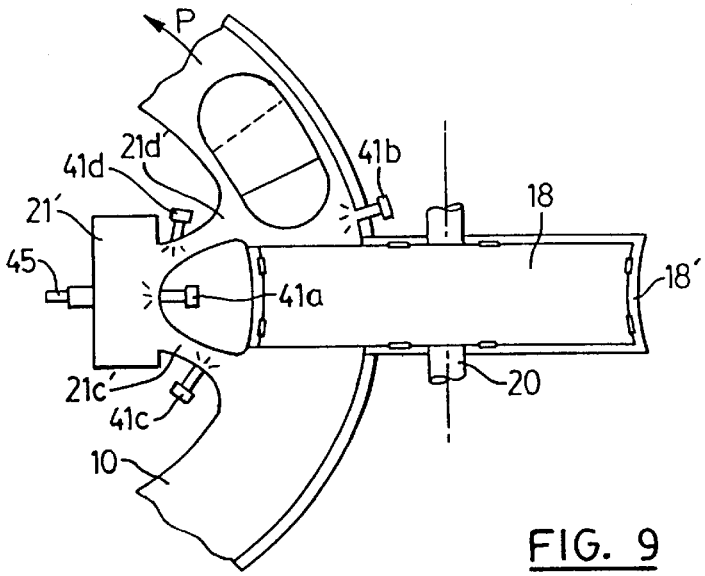
FIG. 9 schematically illustrates a combustion chamber arrangement for a VGT engine employing multi-spot, partial quantity sequential fuel injection.

A further combustion chamber arrangement, schematically illustrated in FIG. 9, is adapted for a VGT engine employing "multispot", partial quantity sequential fuel injection. For greater clarity, the inlet and exit valves shown in previous drawings are not included in this Figure. Again, piston 12 is shown in motion in the circumferential direction P through toroidal chamber 10. Communication between combustion chamber 21' and the interior of toroidal cylinder 10 is through the orifices 21'*c* and 21'*d* of a convergent-divergent nozzle. A spark plug 45 is positioned in combustion chambre 21' and fuel is injected into the combustion chamber through nozzle 41 a the toroidal expansion chamber itself, through nozzle 41*b*, and into the aforementioned orifices through nozzles 41*c* and 41*d*. A multispot injection system of this kind, designed to inject portions of the fuel into a number of different locations for the expansion stroke, improves performance in terms of emissions, power, torque and fuel economy at a variety of speed/load conditions.

As with all illustrated variants of the basic invention, namely, the use of a continually rotating disk valve in conjunction with a non-circular cross-section toroid chamber, the specific "best" partial fuel quantities are determined by combustion modelling and/or experimental trials. In the arrangement of FIG. 9, injection of fuel starts in combustion chamber 21 and, if required, sequentially continued in the transfer passages (orifices) and/or toroidal chamber 10.

According to a second preferred embodiment of the invention, the "variable geometry" consists in providing a piston which is mechanically extendible to minimize the residual volume.

Figure 10A:
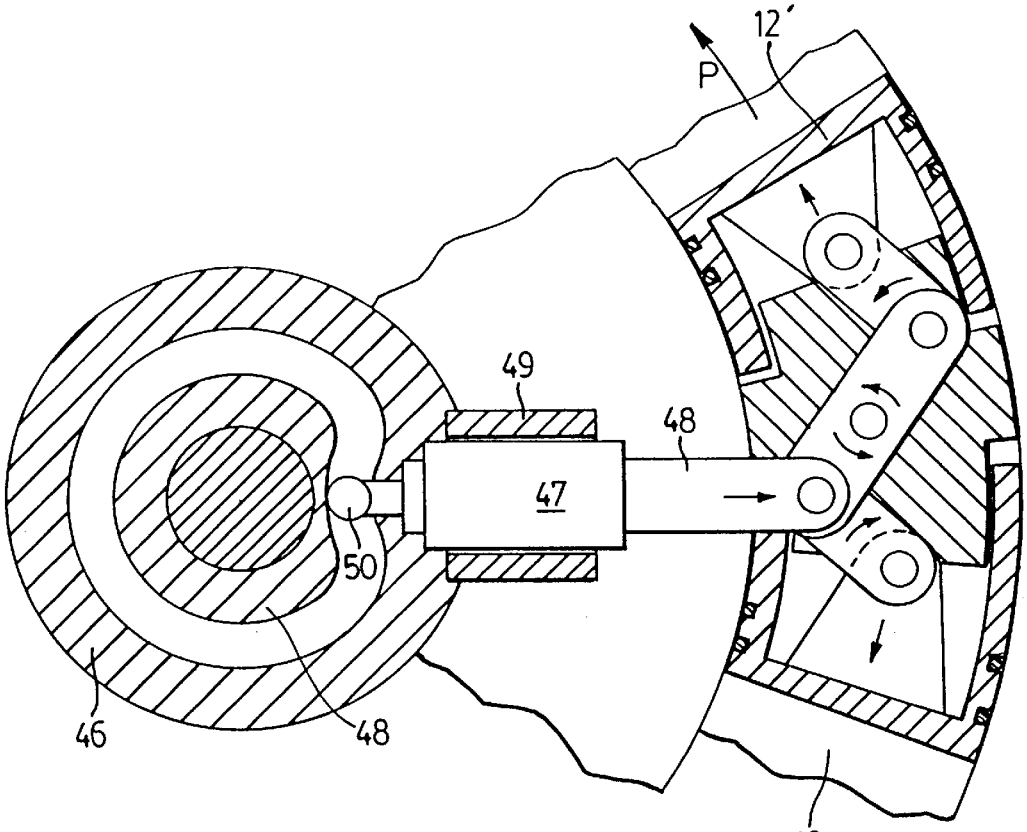
FIGS. 10*a* and 10*b* schematically illustrate the use in a VGT engine of a toroidal dual radius piston having front and rear faces which may be extended or retracted by operation of a centrally located cam mechanism.

FIGS. 10*a* to 11*c* illustrate such mechanical means for approaching still more closely the ideal of near-zero distance between piston and valve between the compression and expansion strokes. Piston 12' is an extendable/retractable piston which in FIGS. 10*a* and 11*a* is shown schematically in the process of extending, with piston sections 12'*a* and 12'*b* separating, following closure of the disk valve and commencement of the expansion stroke under the actuation of hydraulic lifter 47.

Figure 10B:
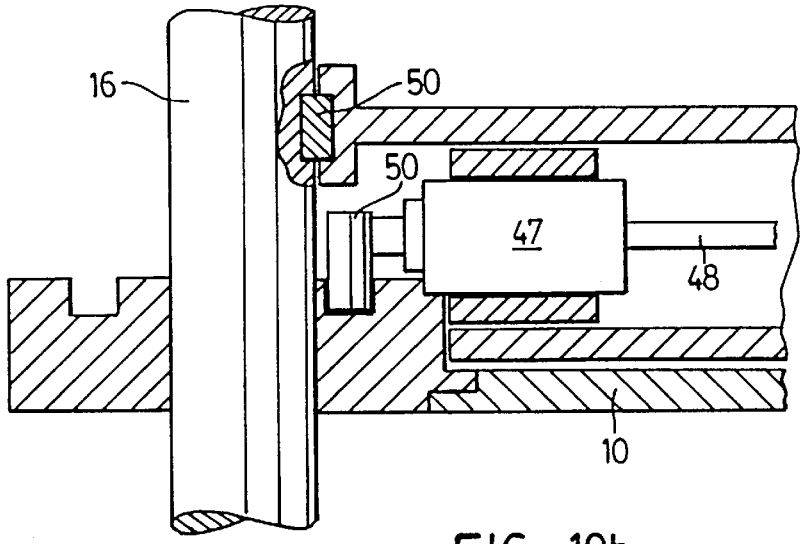

In the specific arrangement of FIGS. 10*a* and 10*b*, push-pull rod 48 undergoes a reciprocating action, as the assembly of hydraulic lifter 47, bushing 49 and push/pull rod 48 is carried around stationary camming 46 and 48 to induce a reciprocating action on key rod 50.

Under the control of the camming arrangement, piston 12', on commencement of the engine compression stroke following closure of the disk valve in front of the piston contracts in length at the same speed as its circumferential motion through the toroidal chamber, permitting a higher degree of compression. Subsequently, following closure of the disk valve behind piston 10 and commencement of the expansion stroke of the engine, as illustrated in FIG. 10*a*, piston 12' extends in length (expands) under the actuation of the hydraulic lifter, again for the purpose of minimizing the space between piston and valve, i.e. the residual volume, during the expansion stroke.

In principle, a VGT engine employing extendible/contractible pistons may perform even more efficiently than the "matched" fixed shape piston arrangement, but this will evidently be at the cost of some complexity and added expense of the engine. Again, however, both approaches are intended to reduce the residual volumes in the compression and expansion strokes in the engine in a way not contemplated, much less realized, in previous rotational engines.

Figure 11A:
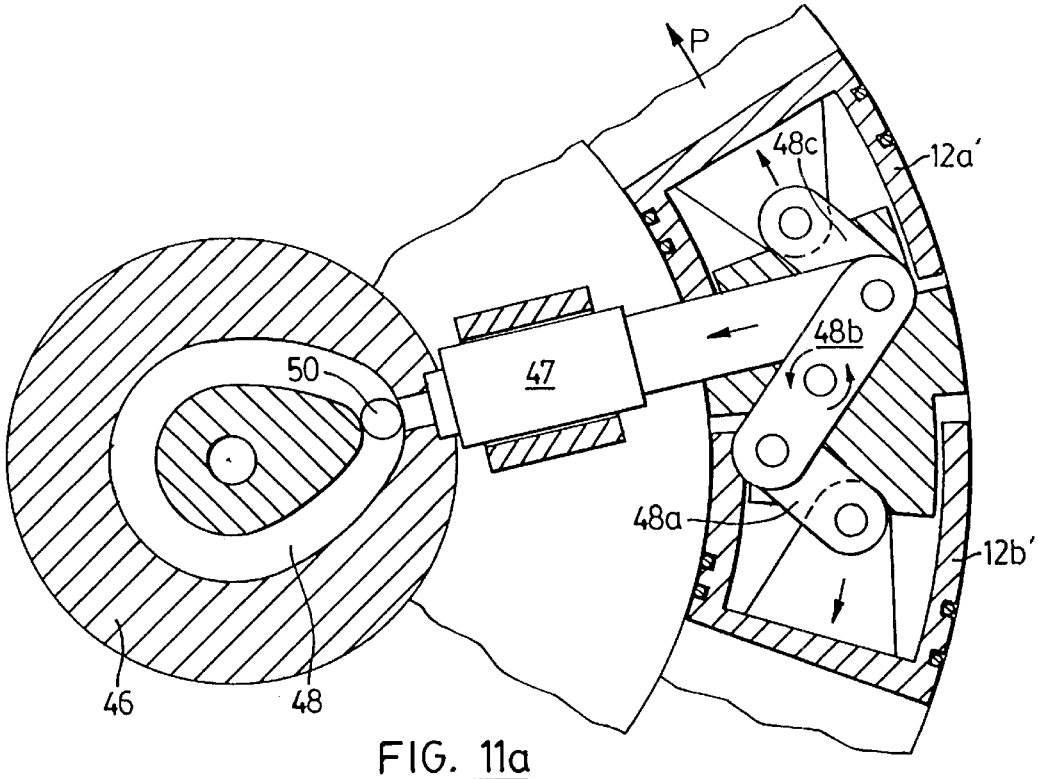
FIGS. 11*a* and 11*b* schematically illustrate an alternate, mechanical drive system for an extendible/retractable piston in a VGT engine according to the present invention.

An alternative camming arrangement for an extendible-piston VGT is shown in FIG. 11*a* which is the same in principle as that of FIGS. 10*a* and 10*b*.

Figure 11B:
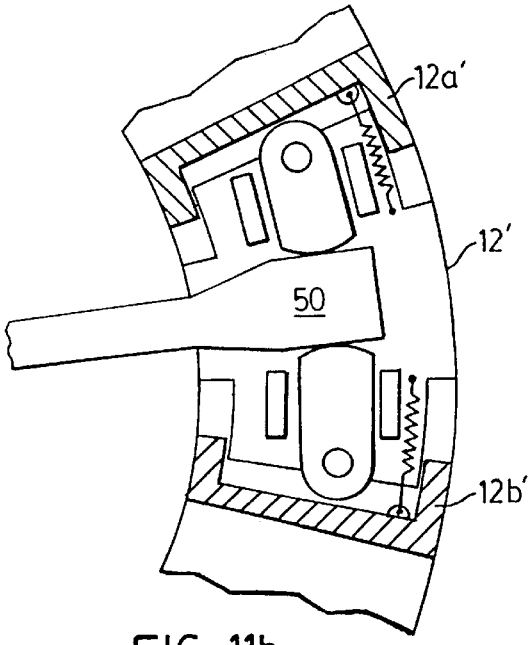

The retracting and expanding motion of the piston in this arrangement can be achieved either by a double crank mechanism 48*a*, 48*b* and 48*c* inside piston 12', as in FIG. 11*a*, or else by a double wedged rod end 50 and spring loaded piston 12 as in FIG. 11*b*. In each case, the piston 12' which approaches the disk valve 18 will shorten its length (retraction), thus reducing the volume in front of the disk valve. Similarly, as the piston passes through the open disk valve it commences to expand, i.e. increase its length, and continues to do so after the disk valve has closed behind the piston so, once again, reducing the volume between the (rear) face of the piston and the disk valve. This ensures that the combustion gas pressure impinges immediately on to the piston without first wasting potential for work by filling a large volume.

Figure 11C:
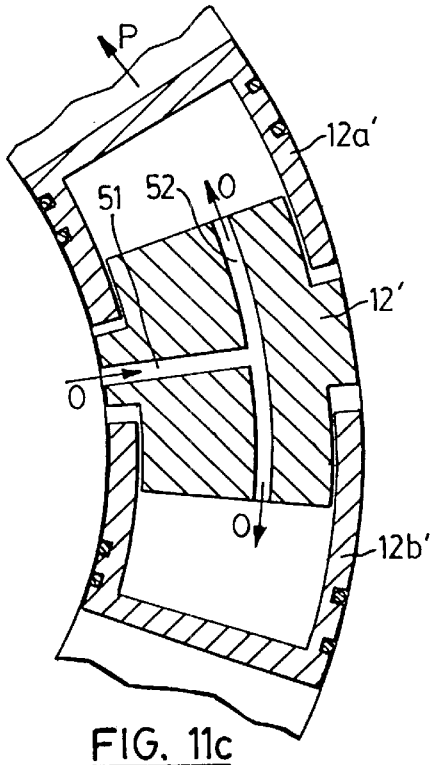
FIG. 11*c* schematically illustrates an alternate hydraulic drive system for an extendible/retractable piston in a VGT engine according to the present invention.

A further variant for effecting the expansion and retraction of the piston 12' in conformity with its speed of passage through the disk valve to minimize dead volume is by hydraulic activation of the expandable/retractable piston as illustrated in FIG. 11*c*. Expansion and retraction are effected by the injection (in the direction of arrows O) or withdrawal of hydraulic fluid through passages 51 and 52.

Figure 12A:
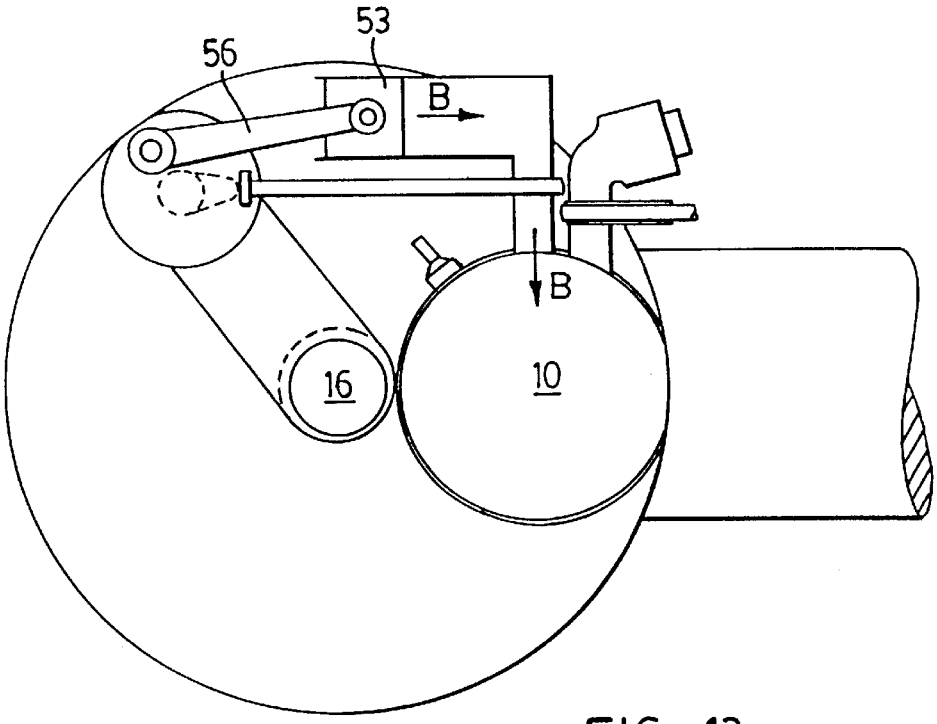
FIGS. 12*a* and 12*b* schematically illustrate the use of an optional separate boost pressure system in conjunction with the toroidal expansion chamber of a VGT engine.
Figure 12B:
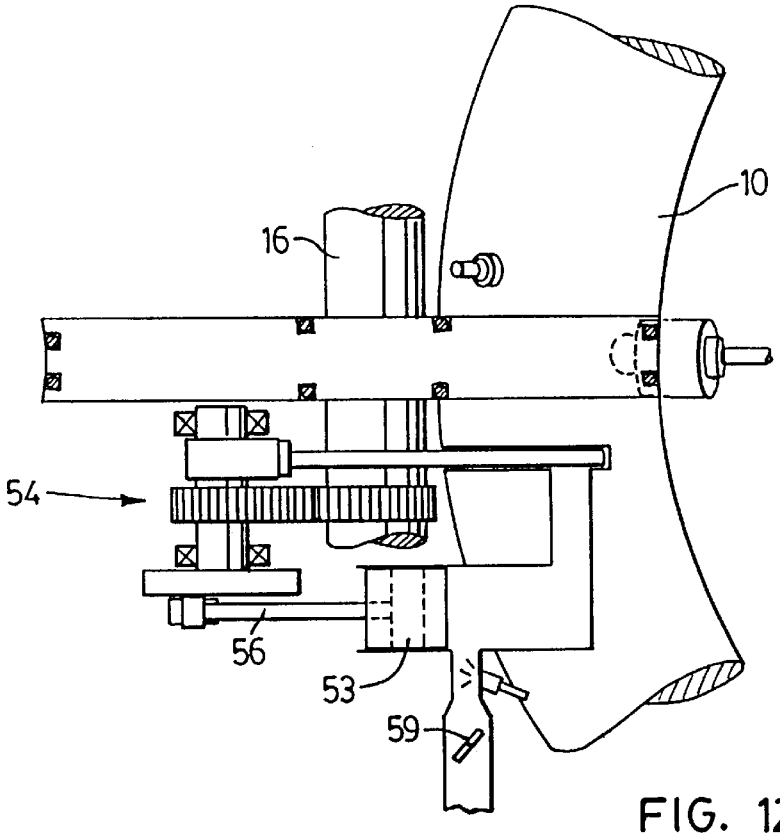

An optional feature of the VGT engine involves the use of a separate boost pressure system in conjunction with the toroid expansion chamber of the VGT engine. Referring to FIGS. 12*a* and 12*b*, there is disclosed an expansion boost pressure device which supplies additional pressure to the toroidal expansion chamber 10 after disk valve 18 is closed. This effect reduces the combustion losses which would otherwise occur as the piston keeps moving circumferentially driven by main shaft 16. The boost pressure device can be either a piston compressor with high compression ratio or any other high pressure vane or roots compressor feeding a charge into the toroidal expansion chamber 10. In drawing FIGS. 12*a* and 12*b* the booster piston is referenced by number 53 and the boost charge is indicated by arrows B as being fed into the toroidal chamber. Disk valve shaft 16 is geared to a drive system 54 which through crank 56, drives the booster piston 53 and provides either compressed air only, or an air-fuel mixture. Reference number 59 in FIG. 12*b* indicates a throttle valve for throttling of fuel into the toroidal expansion chamber.

Figure 13A:
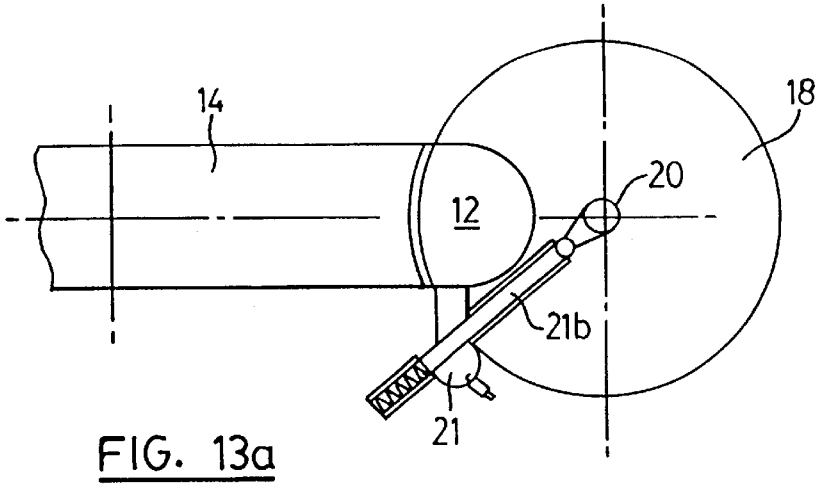
FIG. 13*a* schematically illustrates an arrangement using a direct combustion valve drive.
Figure 13B:
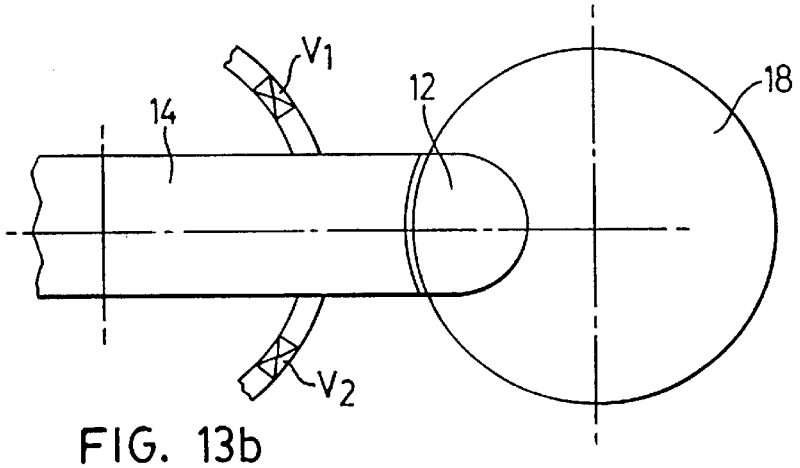
FIG. 13*b* schematically illustrates housing pressurization.

FIG. 13*a* illustrates a combustion chamber improvement which may be referred to as "direct combustion chamber valve drive". The combustion chamber 21 has an intake valve 21 a and an exit valve 21*b* [the former positioned directly behind the latter in this view] which can be driven either from the main shaft 16 about axis 16A with a speed-increasing gear box, or else directly from the disk valve shaft 20, eliminating the gear box. Incorporation of such a direct drive, besides obviating the need for a gear box, may also result in a more compact design having fewer parts and lower weight, with higher engine speeds as a possible consequence. Pressurization of the housing of the VGT engine reduces gap losses and thereby enhances fuel economy and power output.

A still further improvement for pressurizing the toroidal housing 10 is illustrated in FIG. 13*a*. Housing 10 may be externally pressurized alternatively by the admission of supercharger air through shutoff valve $V_1$, or by "booster" air through separate booster through shutoff valve $V_2$.

Figure 13C:
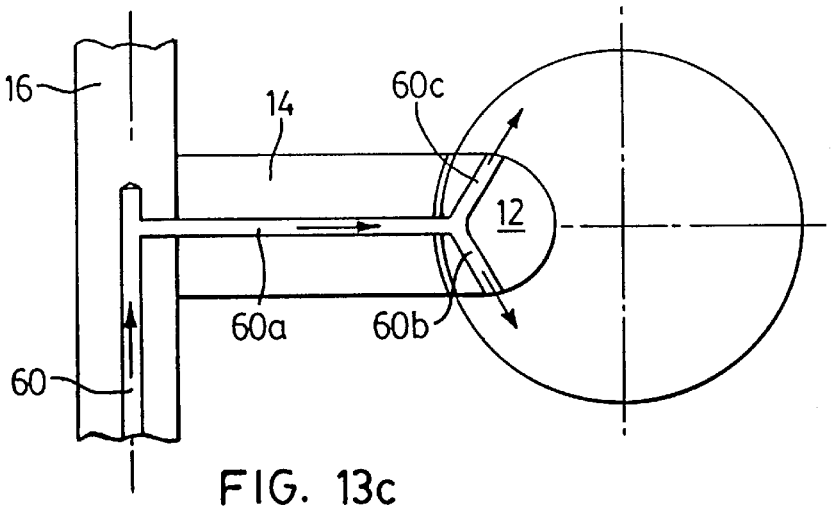
FIG. 13*c* schematically illustrates central lubrication.

Illustrated in FIG. 13*c*, is means for providing central lubrication to the engine. Lubricant is introduced (arrows L) to a piston 12 through a central passage 60 in the main shaft 16, a radial passage 60*a* in the main disk 14 to the outer perimeter, and passages 60*b* and 60*c* extending to piston 12, effecting the dispersion of lubricant through the action of centrifugal force.

It is to be understood that the present invention is not limited to the embodiments described above, but encompasses any and all embodiments and all suitable modifications and equivalents coming within the scope of the appended claims.

I claim:

1. A rotary engine comprising, in combination:

a stationary toroidal piston cylinder which is circular about a main axis of radial symmetry and has a uniform non-circular cross-section, said cylinder cross-section having a radially inner part-circular contour with radius of curvature R2 merging outwardly with a radially outer part-circular contour with radius of curvature R1, R2 being greater than R1;

a piston assembly, comprising a plurality of pistons fixedly mounted to the periphery of a circular mounting disk rotatable about the main axis for unidirectional movement of said pistons in unison in a circular path within said toroidal piston cylinder, each said piston having a forward face, a rearward face and a body portion therebetween, with a surface curvature matching said non-circular cross-section of the toroidal cylinder;

a central shaft extending from the centre of said mounting disk coaxially with said main axis for transmission of energy from the engine;

at least one rotating disk valve perpendicularly intersecting said toroidal piston cylinder, including a peripheral part-circular cutout section which, in use, periodically opens within the piston chamber as the disk valve rotates, to permit passage of a piston therethrough and then to close the passage sealingly, forming an expansion chamber within the cylinder between the closed disk valve and the rearward face of a receding piston;

a source of pressurized fluid and injection means for injecting said pressured fluid into said expansion chamber to impart thrust to said piston in a power stroke;

control means for activating said injection valve, once said expansion chamber is formed;

exhaust means on the cylinder operable to open and to vent fluid from the cylinder after said piston passes by; and means to actuate the rotation of said disk valves in preselected sychronization with the rotation of said central shaft and said piston assembly.

2. A rotary internal combustion engine comprising, in combination:

a stationary toroidal piston cylinder which is circular about a main axis of radial symmetry and has a uniform non-circular cross-section, said cylinder cross-section having a radially inner part-circular contour with radius of curvature R2 merging outwardly with a radially outer part-circular contour with radius of curvature R1, R2 being greater than R1;

a piston assembly comprising a plurality of pistons fixedly mounted to the periphery of a circular mounting disk rotatable about the main axis for unidirectional movement of said pistons in unison in a circular path within said toroidal piston cylinder, each said piston having a forward face, a rearward face and a body portion therebetween, with a surface curvature matching said non-circular cross-section of the toroidal cylinder;

a central shaft extending from the centre of said mounting disk coaxially with said main axis for transmission of energy from the engine;

at least one rotating disk valve perpendicularly intersecting said toroidal piston cylinder, including a peripheral part-circular cutout section which, in use, periodically opens within the piston chamber as the disk valve rotates, to permit passage of a piston therethrough and then to close the passage sealingly, forming a compression cylinder between the closed disk valve and the forward face of an approaching piston and an expansion chamber between the closed disk valve and the rearward face of the receding piston;

an engine ignition system, including a by-pass combustion chamber, means for injecting fuel into said combustion chamber, valved inlet and outlet means associated with the combustion chamber, respectively for receiving air from said compression chamber in a compression stroke for combustion of the fuel-air mixture, and for injecting a high-velocity jet of the burning air-fuel mixture into said expansion chamber to impart thrust to said piston in a power stroke;

air charge means for injecting air for combustion into the cylinder before the forward face of a piston and the disk valve for said compression stroke;

a valved exhaust port on the cylinder operable to open and vent combustion exhaust from the cylinder following said power stroke, after said piston goes by the exhaust port; and means to actuate the rotation of said disk valve in preselected synchronization with the rotation of said central shaft and said piston assembly.

3. A rotary engine according to claim 1, wherein said means to actuate the rotating disk valve is coupled mechanically through said central shaft to the rotational motion of said piston assembly for synchronization of the opening and closing of the disk valve with the passage of each piston through said cutout.

4. A rotary internal combustion engine according to claim 3, including control means coupled mechanically through said central shaft to the rotational motion of said piston assembly for synchronization of the motion of the pistons, the opening and shutting of the rotating disk valve and the operation of said engine ignition system in an engine working cycle.

5. An engine according to claim 1, in which the surface contours of said forward and rearward faces of each piston in said assembly and the contour of the edge surface of said cutout portion of the disk valve are selectively formed to reduce the minimum volumes of said expansion chamber and said compression chamber in operation of the engine.

6. An engine according to claim 1, wherein each of said pistons with front, centre and rear portions and means for reversibly extending and retracting said front and rear portions, respectively to expand or contract said piston longitudinally, and said engine includes means coupled through said crank shaft to the rotational motion of said piston assembly and to said ignition control means for effecting the contraction of a piston during said engine compression stroke and expansion of the piston during said engine compression stroke at a velocity equal to the orbital velocity of said piston, thereby to reduce the minimum volumes attained by said expansion chamber and by said expansion chamber.

7. A rotary internal combustion engine according to claim 4, wherein said rotating disk valve includes an actuating shaft extending axially from the centre of the disk valve and timing belt means operatively coupling said central shaft of the piston assembly to said actuating shaft of the rotating disk valve.

8. A rotary internal combustion engine according to claim 2, wherein said means to actuate the rotating disk valve is coupled mechanically through said central shaft to the rotational motion of said piston assembly for synchronization of the opening and closing of the disk valve with the passage of each piston through said cutout.

9. An engine according to claim 3, in which the surface contours of said forward and rearward faces of each piston in said assembly and the contour of the edge surface of said cutout portion of the disk valve are selectively formed to reduce the minimum volumes of said expansion chamber and said compression chamber in operation of the engine.

10. A rotary internal combustion engine according to claim 2, in which the surface contours of said forward and rearward faces of each piston in said assembly and the contour of the edge surface of said cutout portion of the disk valve are selectively formed to reduce the minimum volumes of said expansion chamber and said compression chamber in operation of the engine.

11. A rotary internal combustion engine according to claim 4, in which the surface contours of said forward and rearward faces of each piston in said assembly and the contour of the edge surface of said cutout portion of the disk valve are selectively formed to reduce the minimum volumes of said expansion chamber and said compression chamber in operation of the engine.

12. An engine according to claim 3, wherein each of said pistons with front, centre and rear portions and means for reversibly extending and retracting said front and rear portions, respectively to expand or contract said piston longitudinally, and said engine includes means coupled through said crank shaft to the rotational motion of said piston assembly and to said ignition control means for effecting the contraction of a piston during said engine compression stroke and expansion of the piston during said engine compression stroke at a velocity equal to the orbital velocity of said piston, thereby to reduce the minimum volumes attained by said expansion chamber and by said expansion chamber.

13. A rotary internal combustion engine according to claim 2, wherein each of said pistons with front, centre and rear portions and means for reversibly extending and retracting said front and rear portions, respectively to expand or contract said piston longitudinally, and said engine includes means coupled through said crank shaft to the rotational motion of said piston assembly and to said ignition control means for effecting the contraction of a piston during said engine compression stroke and expansion of the piston during said engine compression stroke at a velocity equal to the orbital velocity of said piston, thereby to reduce the minimum volumes attained by said expansion chamber and by said expansion chamber.

14. A rotary internal combustion engine according to claim 4, wherein each of said pistons with front, centre and rear portions and means for reversibly extending and retracting said front and rear portions, respectively to expand or contract said piston longitudinally, and said engine includes means coupled through said crank shaft to the rotational motion of said piston assembly and to said ignition control means for effecting the contraction of a piston during said engine compression stroke and expansion of the piston during said engine compression stroke at a velocity equal to the orbital velocity of said piston, thereby to reduce the minimum volumes attained by said expansion chamber and by said expansion chamber.

15. A rotary engine comprising:

a stationary toroidal piston cylinder which is circular about a main axis of radial symmetry and has a uniform non-circular cross-section, said cylinder cross-section having a radially inner part-circular contour with radius of curvature R2 merging outwardly with a radially outer part-circular contour with radius of curvature R1, R2 being greater than R1;

a piston assembly comprising a plurality of pistons fixedly mounted to the periphery of a circular mounting disk rotatable about the main axis for unidirectional movement of said pistons in unison in a circular path within said toroidal piston cylinder, each said piston having a forward face, a rearward face and a body portion therebetween, with a surface curvature matching said non-circular cross-section of the toroidal cylinder;

a central shaft extending from the centre of said mounting disk coaxially with said main axis for transmission of energy from the engine;

at least one rotating disk valve perpendicularly intersecting said toroidal piston cylinder, including a peripheral part-circular cutout section which, in use, periodically opens within the piston chamber as the disk valve rotates, to permit passage of a piston therethrough and then to close the passage sealingly, forming a compression chamber between the closed disk valve and the forward face of an approaching piston, and an expansion chamber between the closed disk valve and the rearward face of the receding piston, said rotating disk having a front edge and a rear edge proximate said cutout section;

an engine ignition system, including a by-pass combustion chamber, an injection system, and inlet and outlet valves, said inlet valve for receiving air from said compression chamber in a compression stroke for combustion of the fuel-air mixture, and said outlet valve for injecting a high-velocity jet of the burning air-fuel mixture into said expansion chamber to impart thrust to said piston in a power stroke;

a valved exhaust port on the cylinder at a location between the rear face of a piston and the disk valve following said power stroke;

a drive connecting said disk valve and said central shaft, said drive configured to operate said disk valve and said pistons in synchronization.

16. The rotary engine according to claim 15, further comprising a boost pressure system connected to said cylinder at a location between said forward face of said piston and said disk valve during said compression strokes.

17. The rotary engine according to claim 15, wherein said surface contour of said forward face of each piston conforms to the surface contour of said rear edge of said rotating disk valve and said surface contour of said rearward face of each piston conforms to the surface contour of said forward edge of said rotating disk valve.

18. The rotary engine according to claim 17, wherein said forward face of each piston is slanted relative to the plane of rotation and three-dimensionally curved, said rearward face of each piston is slanted relative to the plane of rotation and three-dimensionally curved, said rear edge of said rotating disk valve is convex, and said forward edge of said rotating disk valve is convex.

19. The rotary engine according to claim 15, wherein said pistons can be expanded and retracted during rotation.

* * * * *